United States Patent [19]

Kim

[11] 3,934,298

[45] Jan. 27, 1976

[54] TOOTHBRUSH

[76] Inventor: James S. H. Kim, 105 Kingston Court, New Orleans, La. 70114

[22] Filed: Apr. 23, 1974

[21] Appl. No.: 463,205

[52] U.S. Cl. ..... 15/167 R; 15/106

[51] Int. Cl.[2] ..... A46B 9/04

[58] Field of Search..... 15/167 R, 167 A, 176, 106

[56] References Cited

UNITED STATES PATENTS

| | | | |
|---|---|---|---|
| 1,682,548 | 8/1928 | Bigoney | 15/167 |
| 1,981,657 | 11/1934 | Miller | 15/167 |
| 2,043,898 | 6/1936 | Malcolm | 15/167 |
| 2,845,649 | 8/1958 | Hutson | 15/167 |
| 3,624,667 | 11/1971 | Muhler | 15/167 |
| 3,742,549 | 7/1973 | Scopp et al. | 15/167 |

FOREIGN PATENTS OR APPLICATIONS

| | | | |
|---|---|---|---|
| 1,100,290 | 3/1955 | France | 15/167 |
| 177,878 | 3/1954 | Austria | 15/167 |

*Primary Examiner*—Peter Feldman

*Attorney, Agent, or Firm*—Pugh & Keaty

[57] ABSTRACT

A double-ended toothbrush having two bristle portions, a major or larger, contoured bristle portion at one end and a minor or smaller wedge-shaped bristle portion at the other, both formed of parallel rows of bristles extending out perpendicularly from a base which is longer and narrower than most available toothbrushes. The larger brush head has four parallel rows of tufts (except at its end) which are shaped or contoured to conform to the natural contour of the teeth and gingivae, with the two outer rows forming a shallow concavity, the shape allowing the use of the natural back-and-forth brushing action. The smaller, interdental brush head is made of six tufts arranged in two parallel rows which are cut in a uni-bevel facing outwards to form a small wedge-shaped interdental brush.

10 Claims, 16 Drawing Figures

TOOTHBRUSH

BACKGROUND OF THE INVENTION

1. Field of Invention

The present invention relates to a tooth-brush and its method of use wherein the tooth-brush in its preferred embodiment is double-ended with major and minor bristle portions, both of which are specially shaped.

2. Discussion of Prior Art & Present Invention

A major cause of tooth decay and periodontal disease is the accumulation of plaque, a sticky, invisible film of bacterial growth, at the gingival margins and between the teeth. Daily removal of this harmful plaque with gingival massaging is the key towards better dental health. Up to this date the only near effective way in removing this daily formation of bacterial film from the above areas is the combined use of single-ended toothbrushes and dental flosses.

The major problem with most available single-ended toothbrushes of the prior art is that their effectiveness depends upon very restricted, proper brushing techniques i.e., brushing towards the gingivae or away from the gingivae with a vibratory action that is relatively difficult and unnatural with respect to a user's normal brushing tendency. These toothbrushing techniques (Stillman's and Charter's) depend upon the clinical condition of the gingivae. Since clinical conditions vary and change with age, it is impossible to examine and instruct every individual on which technique is best to use. Also, a large percentage of the public are not fortunate in having a regular dentist to teach them how and where to concentrate their brushing. Another shortcoming of single-ended toothbrushes is their limited ability in cleaning deep between the teeth, under fixed dental bridges, and around orthodontic appliances.

At present, the only relatively effective way of cleaning between the teeth is by the use of dental floss. However, many people have difficulty in manipulating a floss between their back teeth, under fixed bridges and between teeth that are splinted together. Flossing also cannot clean periodontally involved concave surfaces of the posterior teeth, nor provide necessary gingival massaging action. Moreover, quite often, dental flosses are not readily available.

The double-ended toothbrush of the present invention and its method of use is designed to overcome the above shortcomings with clinical effectiveness and simplicity of use. Each brush head or bristle portion of the double-ended brush is especially designed for a specific clinical purpose and co-operatively complements the other to provide maximum efficiency and effect.

The overall design of the toothbrush of the present invention is longer and narrower than most available toothbrushes with a large contoured brush at one end and a small wedge-shaped brush at the other, with both being on the same side and perpendicular to the base. The larger brush head of the preferred embodiment has four parallel rows of tufts, except the three end tufts that are arranged to conform to the rounded end or head of the brush. The narrow width of the parallel rows, plus the three end tufts at the tapered, rounded end, permits a better accessibility of closely confined buccal areas of third molars, than the wider and blunt ended toothbrushes of the prior art. Each tuft and preferrably has multiple, fine nylon bristles that are end-rounded and polished to minimize tooth abrasion and injury to soft tissues.

The bristles of the larger brush of the preferred embodiment are shaped to conform to the natural contour of the teeth and gingivae. The two outer parallel rows are wedge-shaped with an outer bevel of approximately 45°, as compared to non-beveled contoured prior art brushes such as for example that shown in U.S. Pat. No. 1,682,548 to Bigoney (issued Aug. 28, 1928) or in Australian Pat. No. 177,878 (issued Mar. 10, 1954). This outer bevel is designed to gently compress and stimulate the crest of the marginal gingivae. The inner bevel, plus the inner rows and three end tufts form a shallow concavity. The bristles are all perpendicular to the base and parallel to each other to avoid the direct, deep penetration and injury to gingival attachments that may occur with the flared-out bristles (note FIG. 8 hereof), found in the "contoured" toothbrushes of the prior art, that cannot bend readily away from the gingiva, as for example, French Pat. No. 1,100,290 to Guzman published Sept. 19, 1955. The shallow concavity also prevents deep penetration of the bristles into the gingival attachments, and traumatic condition that can easily occur with the deep, concave brushes known in the prior art (note FIG. 9 hereof and for example German Pat. No. 818,794 to Karagoumis issued May 23, 1952). Additionally the bristles forming the main body of the brush are identical along the length of the brush as compared to varying configured contoured toothbrushes of the prior art such as for example that shown in U.S. Pat. No. 2,043,898 to Malcolm (issued June 9, 1936).

The natural, contoured design of the present invention allows the brush to be positioned readily and provides maximal cleansing action at the critical gum margin areas. The fine, flexible, perpendicular bristles allow safe back-and-forth brushing action, a natural tendency of children and most adults.

The smaller interdental brush head or bristle portion of the preferred embodiment is quite versatile and is made of six tufts of fine flexible nylon bristles, arranged in two parallel rows. The parallel rows of tufts are cut in a uni-bevel facing outwards to form a small wedge-shaped brush. This wedge-shaped brush is very effective in cleaning between the teeth, under fixed dental bridges, between splinted teeth, around orthodontic appliances, and behind third molar areas not reached by ordinary toothbrushes. Most important, it has the ability to reach concave interproximal surfaces of periodontally involved posterior teeth which cannot be reached by flossing.

The uni-bevel cut permits maximum contact and produces deeper penetration of the bristle ends between the interproximal surfaces of adjacent teeth than any of the small brushes of the prior art, for example those with flat-ended tufts (shown in FIG. 11) such as for example that shown in U.S. Pat. No. 46,450 to Sarrazin (issued Sept. 22, 1914), or bi-beveled tufts (shown in FIG. 12) such as for example that shown in U.S. Pat. No. 52,385 to Clapp (issued Sept. 10, 1918).

The sides of the two end tufts of the small two-row brush portion of the preferred embodiment provides safer stimulation of the interdental papillae structure (note FIG. 13) than that found in the prior art as shown diagrammatically in FIGS. 13A–13C. The small space between the two end tufts of fine, flexible bristles of the present invention permits a more gentle conformity around the crest of the interdental papilla (FIGS. 13A), in contrast to the direct traumatic compression exerted upon the crest by the hard rubber interdental stimulators of the prior art (FIG. 13B) such as for example that shown in U.S. Pat. No. 2,141,969 to Benz (issued Dec. 27, 1938), or for that matter any other small wedge-shaped brush with odd numbered rows, for example, three, as shown in FIG. 13C.

There has been a definite need for a small wedge-shaped toothbrush made of multiple fine, flexible bristles having the structure of the interdental brush of the present invention which will effectively deep clean and massage the interproximal areas of the teeth, under fixed bridges, between splinted teeth, and around orthodontic appliances. Thus a most important aspect of the small interdental brush 3 is its ability to clean all types of interproximal surfaces of periodontally involved teeth.

The success of periodontal treatment and prevention is very dependent upon how well the patient cleans and massages periodontally involved interproximal spaces. The only tools heretofore readily available for periodontal home care have been ordinary toothbrushes, rubber tip stimulators, dental flosses, toothpicks and brushes that resemble miniature bottle washers.

The shortcomings of such prior art devices are generally outlined below:

1. Ordinary toothbrushes—Large size limits concentrated interproximal action, thereby limiting its ability to clean deep periodontal pockets.
2. Rubber tip stimulators—The single hard structure has poor cleansing action, and does not conform to other shapes which may be harmful to normal interdental papillae if improperly used.
3. Dental flosses—Can not clean concave grooves of periodontally involved multi-rooted teeth. It is difficult to use in posterior areas, under fixed bridges, between splinted teeth, and around orthodontic appliances. It does not provide necessary gingival massage.
4. Toothpicks—Poor cleansing action on dental plaque formations, and habitual use may be harmful to interdental papillae and tooth structure.
5. Bottle washer type brush—Difficult to use in tight interproximal spaces and not designed to provide gingival massage. Its use is limited to a very small percentage of patients with advanced periodontal disease, and is not readily available to the public.

The small wedge-shaped brush of the present invention allows concentrated cleansing and massaging ability in all types of interproximal spaces. The two end tufts of the small, double row brush of the present invention readily conform to any shaped interdental papillae to provide gentle and necessary gingival stimulation. The multiple ends of fine, flexible bristles on each side of the wedge provide a wide scrubbing action from deep periodontal pockets up to the tightest contact points. The small brush also allows through and through cleansing of advanced periodontal conditions and deep cleans concave interproximal surfaces. The small brush easily maneuvers under the smallest three-unit fixed bridge, between splinted teeth and around orthodontic appliances.

SUMMARY OF DIFFERENCES

Thus, in summary, the contoured double-ended toothbrush of the present invention has the following significant differences over the prior art:

1. The large, contoured brush portion and its specific shape allows the brush to be positioned readily to provide maximal cleansing action at the critical gum margin areas and allows the simplicity of natural back-and-forth brushing without any of the draw backs of the prior art. 2. The fine, flexible bristles of the main contoured brush portion are arranged perpendicular to the base, and contoured gently with only a shallow concavity, to avoid direct deep penetration of the gingival attachments that may occur with flared-out bristles or brushes with deep concavities and are identical throughout the length of the main brush body and form wedge-shaped bevels along both side edges. 3. The small, two-row, wedge-shaped interdental brush, with each tuft cut in a uni-bevel, provides greater efficiency of all the bristle ends in the deep cleansing of interproximal tooth surfaces, in comparison with a single strand of dental floss, or other two-row brushes of the prior art that have flat-ended tufts or bi-beveled tufts.

4. The parallel sides of the two tufts of the small interdental brush conform more gently around the crest of the interdental papillae than any small brush with odd numbered rows or any hard rubber tip.

PERTINENT PRIOR ART PATENTS

The art of the present invention is a crowded one and the search for the ideal solution to the problems of tooth brushing and proper dental care has been a long one, the need therefor being long felt.

The broad concept of specially designing the bristle direction and configuration of a tooth-brush has been long explored in the prior art, and the below listed U.S. patents are exemplary thereof:

| No. | Inventor(s) | Issue Date |
|---|---|---|
| Re,22,938 | C. Kisky | November 25, 1947 |
| 1,901,646 | H. W. Hicks | March 14, 1933 |
| 1,943,225 | H. W. McIntyre | January 9, 1934 |
| 2,004,633 | S. C. Miller | June 11, 1935 |
| 2,040,245 | R. A. Crawford | May 12, 1936 |
| 2,097,987 | C. E. Phillips | November 2, 1937 |
| 2,154,352 | H. C. Peterson | April 11, 1938 |
| 2,186,005 | G. L. Casto | January 9, 1940 |
| 2,237,694 | B. Altstadt | April 8, 1941 |
| 2,263,360 | L. P. Karshmer | November 18, 1941 |
| 2,622,259 | F. E. Chauvin | December 23, 1952 |
| 2,978,724 | C. C. Gracian | April 11, 1961 |
| 3,100,309 | J. C. Gambino | August 13, 1963 |
| 3,188,673 | J. E. Newman | June 15, 1965 |
| 3,229,318 | G. S. Clemens | January 18, 1966 |

Reference is also made to the four patents direct to "contoured" toothbrushes referred to above, namely the patents to Bigoney, Guzman, Karagounis and Malcolm.

The broad concept of having double-ended toothbrushes, that is a toothbrush structure having two separate bristle portions, one at either end, is of course also old, and the below listed U.S. patents are exemplary thereof:

| No. | | Inventor(s) | Issue Date |
|---|---|---|---|
| Design | 139,524 | L. J. Laskin | November 28, 1944 |
| | 158,099 | M. A. R. Lowd | December 22, 1874 |
| Design | 207,303 | James W. Moll | April 4, 1967 |
| | 1,048,740 | J. J. Sarrazin | December 31, 1912 |
| | 1,132,326 | J. F. Fowyer | March 16, 1915 |
| | 2,084,873 | L. J. Strause | June 22, 1937 |

As brought out above with reference to the patents to Sarrazin, Clapp and Benz, broadly speaking, small interdental brushes or elements are also known in the prior art. Other typical examples are listed below:

| No. | Inventor(s) | Issue Date |
|---|---|---|
| 1,929,530 | M. Abelson | October 10, 1933 |
| 3,146,478 | S. R. Rosenthal | September 1, 1964 |
| 1,476,579 | H. Barnes | December 4, 1923 |

However, the present invention is directed to a most unique and special combination nowhere found in this crowded art which, it is believed, produces far superior results to that of the prior art, although such results have been long desired and sought after.

BRIEF DESCRIPTION OF DRAWINGS

For a further understanding of the nature of objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Structure

Figure 1:
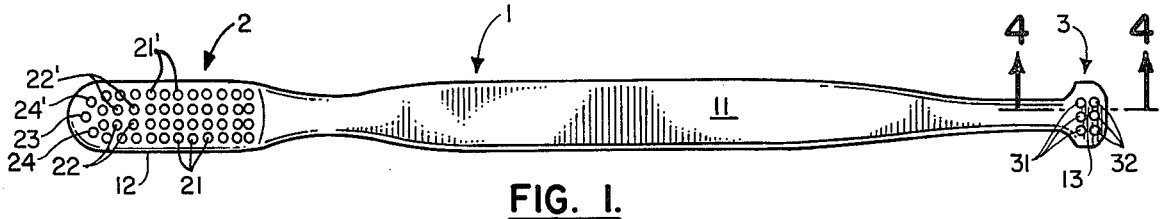
FIGS. 1 and 2 are top and side views, respectively, of the preferred embodiments of the Contoured Double-Ended Toothbrush of the present invention.
Figure 2:
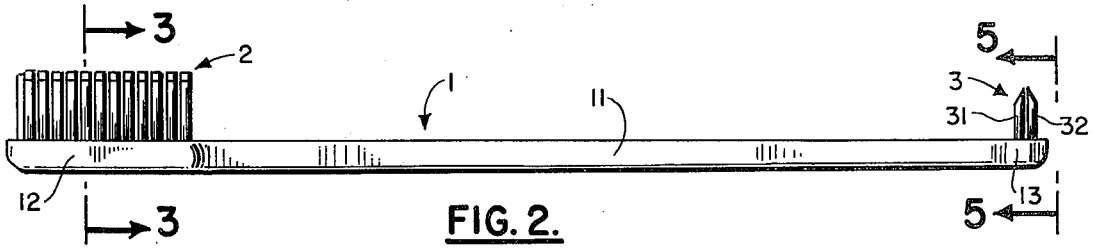
Figure 3:
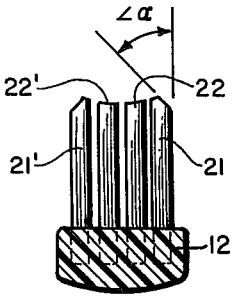
FIG. 3 is an end, cross-sectional view of the embodiment of FIGS. 1 and 2, taken along section lines 3—3 of FIG. 2.
Figure 4:
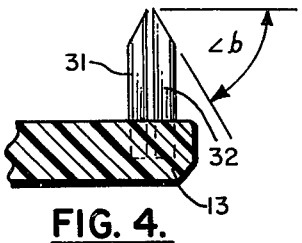
FIG. 4 is a side, cross-sectional view of the embodiment of FIGS. 1 and 2, taken along section lines 4—4 of FIG. 1.
Figure 5:
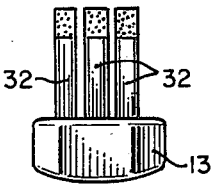
FIG. 5 is a rear end view of the preferred embodiment of the Contoured Double-Ended Toothbrush of the present invention, taken in the direction lines 5—5 of FIG. 2.

With particular reference to FIGS. 1 through 5, the preferred embodiment of the contoured double-ended toothbrush of the present invention comprises a toothbrush having two bristle or brush portions 2, 3, a major or larger, contoured bristle portion 2 at one end 12 and a minor or smaller wedge-shaped interdental bristle portion 3 at the other end 13. Both of the bristle portions 2, 3 are formed of parallel rows of bristles extending out perpendicularly from a base handle 1. Each brush head 2, 3 is especially designed for a specific clinical purpose, but both each cooperatively complements the other to provide maximum efficiency in providing cleaning and proper dental health.

The overall design of the toothbrush base 1 is longer and narrower than most available toothbrushes. The base 1, which can be made of plastic, can be for example seven inches long with a maximum width of 0.437 inches at its handle and tip portions 11, 12, 13.

The larger brush head 2 has four parallel rows 21, 21′, 22, 22′ of tufts, except that the three end tufts 23, 24, 24′ are arranged to conform to the rounded end of the tip 12 of the toothbrush. Each tuft can be approximately two mm. in diameter and spaced approximately a half mm. apart.

Figure 6:
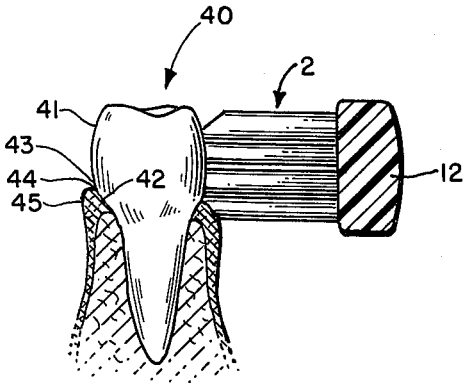
FIGS. 6 and 7 are end views showing the larger, contoured brush portion of the preferred embodiment in its mating engagement with the side of a tooth, FIG. 6 showing the brush in direct head-on contact and FIG. 7 showing the engagement action as the brush is moved.

The bristles of the larger brush 2 are shaped to conform to the natural contour of the teeth and gingivae (note FIG. 6). The two outer, parallel rows 21, 21′ are wedge-shaped with the outer bevel having an angle alpha (note FIG. 3) which can be approximately 45°. The outer bevel shape is important and enhances the massaging action on the gingivae as the teeth are being cleaned. The inner bevel of tufts 21, 21′ plus the inner rows 22, 22′ and the three end tufts 23, 24, 24′ form a shallow concavity, the cavity having a preferred depth of approximately one-half a millimeter to a preferred maximum depth of three-quarters of a millimeter and having a preferred width of approximately 0.27 mm. The curvature of the cavity can be that formed by a circle having a half inch radius.

It is noted that the bristles are all perpendicular to the base 1 and are parallel to each other with no flare. The bristles are preferrably made of multiple fine nylon bristles that are end-rounded and polished to minimize tooth abrasion and injury to soft tissues. Moreover the bristles are the same throughout the main body of the brush 2 as the brush is traversed along its length. Thus, a cross-sectional view similar in perspective to that of FIG. 3 would be the same throughout the brush 2 except at its rounded end portion formed by the tufts 23, 24, 24′.

A further significant aspect of the present invention is that each of the individual tufts of the outer rows 21 21′ are themselves wedge-shaped having a flat, outward facing bevel, in contrast to the cone-shaped tufts of some prior art designs which have curved tips.

The smaller, interdental brush 3 formed on the opposing end 13 of the handle 1 consists of two parallel rows 31, 32 of beveled, vertical bristles symetrically formed so as to, in cooperation, form a pointed end. Each opposing beveled portion forms an angle beta (note FIG. 4) which can be for example sixty degrees, thereby forming an outward facing uni-bevel producing a wedge-shape.

The brush 3 can be made for example of a total of six tufts of fine flexible nylon bristles. The rectangle formed by the six tufts (as viewed from above as in FIG. 1) measures approximately 6 mm. in length and 4 mm. in width with the tufts being approximately a half mm. apart.

METHOD OF USE

The main brush 2 is best used with short, back-and-forth strokes starting from all the back teeth and working toward the front, on both sides. Particular concentration of use should be had on the outside of the back teeth, where most debris collects.

Figure 7:
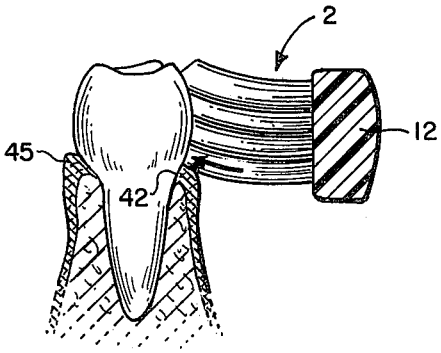
Figure 8:
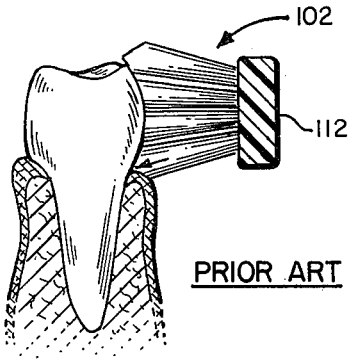
FIGS. 8 and 9 are side views similar in perspective to FIGS. 6 and 7, but showing the engagement of the bristles of two different prior art embodiments of contoured toothbrushes.
Figure 9:
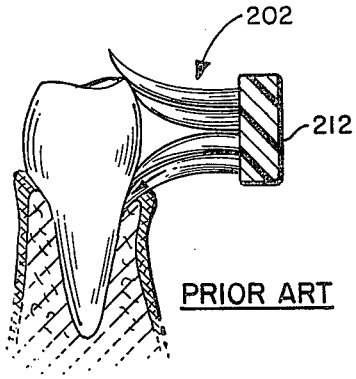

As shown in FIG. 6, the contour of the cavity of the brush 2 is designed to mate with the rounded outer surface 41 of the tooth structure 40, and the beveled sides to the marginal gingiva 45. It is noted that the bristles are not flared but are all parallel to each other and perpendicular to the handle base structure 12. This is all in contrast to the prior art as illustrated in FIGS. 8 and 9; where in the prior art side flare design of the brush 102 of FIG. 8 there is a relatively traumatic, direct thrust (note arrow) of the flared out bristles into the gingival attachment 42; and where in the prior art deep cavity design of the brush 202 of FIG. 9 the deep cavity forces the bristles into the gingival attachment 42. It should be further noted that, as illustrated in FIG. 7, when the brush 2 of the present invention is pushed against the marginal gingival areas 45, the fine flexible perpendicular bristles bend away from the gingiva (note arrow), producing a gentle massaging action, rather than a direct thrusting action into the gingival attachment 42, which is relatively traumatic and occurs with the contoured prior art designs of FIGS. 8 and 9.

It should be noted that a major cause of tooth decay, gingivitis and periodontal disease is the collection of food debris, materia alba, plague and tarter formation at the marginal gingival areas 45 of the teeth. Thorough cleansing of this critical area and daily massaging of the marginal gingiva will significantly reduce caries rate and periodontal disease. This marginal gingival area of teeth includes the supra-gingival (above crest) 43 and sub-gingival (below crest) 44 areas.

It is further noted that most toothbrushes heretofore available to the public have had cone-shaped tufts of hard bristles on flat surfaces or soft bristles, which are not designed to clean the sub-gingival areas. These hard bristled toothbrushes can cause abrasion of teeth or injure the gums if improperly used. Since these toothbrushes were usually the only ones available, only two toothbrushing techniques have been generally recommended by the dental profession:

1. for older adults with some periodontal disease and receding of the gums, the bristles are angulated away from the gums and used in a vibratory manner towards the gums; and
2. for children and young adults with healthier gums, the procedure is reversed, i.e., sweeping away from the gums to the biting surfaces.

However neither of the above techniques will effectively clean the marginal gingival areas 45 of the teeth. Also, individual dental problems may require one or the other, or a combination of both techniques. Most children and adults do not know how to use these techniques, and have a natural tendency to brush their teeth in a back-and-forth scrubbing action. Since it is impossible to teach everyone a proper technique according to individual dental problems, it is imperative that a toothbrush provide maximal efficiency when used in a natural manner as is done in the present invention. Thus the head of the major brush 2 is designed to conform to the natural contour of teeth and gingival attachments for thorough cleansing of the critical marginal gingival areas and massaging of the gums, when used in a natural back-and-forth manner. Thus a most significant feature of the toothbrush of the present invention is the use of wedge-shaped tufts on the outer rows 21, 21' in contrast to cone-shaped tufts used in most toothbrushes in use today. The crest of the wedge-shaped tufts 21, 21' will clean the marginal gingival areas 45 more effectively than any other toothbrush, while the closely spaced flat outer slopes massage the marginal gingiva without trauma. Although the crest of the wedge is forced slightly into the sub-gingival area for cleansing, the flat outer slope prevents deep penetration of the bristles which can injure the gingival attachments. No other toothbrush of the prior art can, it is believed, clean the sub-gingival areas without causing injury to the gums. The symmetrical contoured design of the present invention also permits the user to correctly position the brush head to the upper or lower, right or left, dental arches.

The contoured brush head 2 of the present invention would be very effective on an electric toothbrush that has a back-and-forth vibratory action. It would be more effective than the present electric toothbrushes which use a rotary or up and down type of action.

After using the main brush head 2, the smaller interdental brush 3 is used to follow up its action. As plague between the teeth is the major cause of gum disease and tooth decay, the use of the interdental brush 3 is most important.

Figure 10:
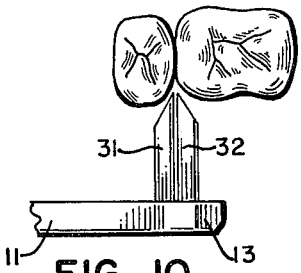
FIG. 10 is a top view showing the smaller wedge-shaped brush or bristle portion of the preferred embodiment of the present invention in engagement with the sides of two adjoining teeth.

As illustrated in FIG. 10, the sides of the two end tufts are pressed against the gums with the bristle ends between the teeth. The brush 3 forms a wedge that easily fits between the teeth, the ends of the beveled bristles providing effective cleansing of both adjacent teeth at the same time. The sides of the tufts or each row 31, 32 will conform to any size and shape of an interdental papilla 46 for safe and gentle stimulation under a vibratory action.

The brush 3 is vibrated or moved vigorously, and this action repeated several times on both sides with particular concentration on any tender, bleeding areas. For the front teeth, the end of the brush 3 is slide over to the gums on the tongue side and the bristles ends are vibrated (vigorously moved) between the teeth. The brush 3 is also used to clean the marginal gum areas under any fixed bridges, around any braces, behind the last tooth, and around any teeth that may hold partial dentures. Bacterial film is removed by the brush 3 from the inside of any metal clasps that contact tooth surfaces.

Figure 11:
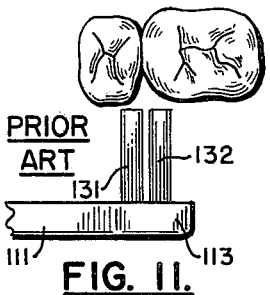
FIGS. 11 and 12 are views similar in perspective to FIG. 10, but showing the engagement of the bristles of two prior art type toothbrushes with the teeth.
Figure 12:
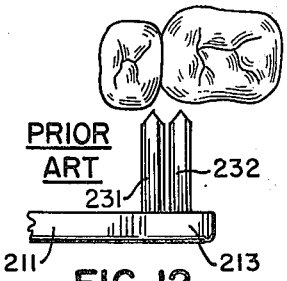
Figure 13:
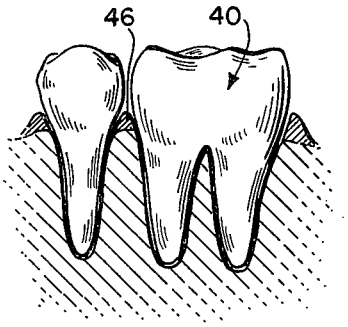
FIG. 13 is a side view of two adjacent human teeth in their bony sockets, with the space between the teeth above the alveolar bone filled with normal interdental papilla (gingival tissue).
Figure 13A:
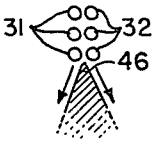
FIGS. 13A–13C are side views showing the interaction with the papilla (Diagrammatically sketched) between the brushing or massaging action of the smaller bristle portion of the preferred embodiment, a hard rubger tip prior art embodiment, and a tri-row bristle brush embodiment, respectively.
Figure 13B:
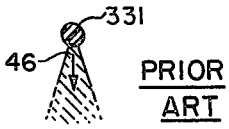
Figure 13C:
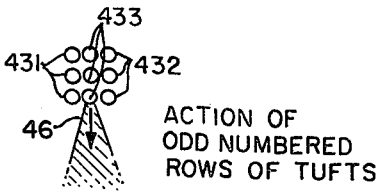

The proper fit and action of the wedge-shaped brush 3 of the present invention as illustrated in FIG. 10 should be contrasted with what is believed to be the mere paper teachings of the prior art as illustrated in FIGS. 11 and 12, which clearly cannot produce the massaging and cleaning action of the brush 3. Likewise the fit and action of the even number of rows (for example two as disclosed) on the crest of the interdental papilla 46 of the present invention as illustrated in FIG. 13A should be contrasted with the traumatic compressive actions of the hard rubber stimulator 331 of the prior art illustrted in FIG. 13B and a structure having three rows 431, 432, 433 or other odd numbered rows of tufts illustrated in FIG. 13C on the crest of the interdental papilla 46. Thus in the present invention the two rows 31, 32 are easily spread to the sides of the crest of the interdental papilla 46, causing a gentle, cleansing, massaging action, while the embodiments of FIGS. 13B and 13C result in a relatively traumatic compressive action upon the crest 46.

The interdental brush 3 thus cooperates with and interrelates with the action of the main brush 2 is providing full and complete dental cleaning and dental health. It is noted that the relatively small, wedge-shaped interdental brush 3 allows a deeper cleaning of the interdental spaces and through and through cleansing of peridontally involved dentition than is possible with ordinary-sized toothbrushes including brush 2. The ready availability of the interdental brush 3 on the same toothbrush handle 1 as the main brush head 2 provides for a more effective and complete home dental care plan.

Because many varying and different embodiments may be made within the scope of the inventive concept herein taught, and because many modifications may be made in the embodiment herein detailed in accordance with the descriptive requirements of the law, it is to be understood that the details herein are to be interpreted as illustrative and not in a limiting sense.

What is claimed as invention is:

1. A double-ended tooth-brush comprising:

an elongated handle having two end portions;

a first major brush portion mounted on one of said end portions consisting of a group of parallel, juxtaposed tufts, defining at least generally a rectangular configuration, of parallel bristles emanating out from said handle in a direction perpendicular thereto, the ends of said bristles of said juxtaposed tufts together forming a contoured, cylindrical working surface the axis of which is parallel to the longitudinal axis of said handle, said cylindrical surface terminating at at least one side edge thereof in a flat beveled surface which extends the full length of said group of tufts; and a second smaller interdental brush portion mounted on the other of said end portions consisting of a group of parallel, juxtaposed tufts, defining at least generally a rectangular configuration, of parallel bristles emanating out from said handle in a direction perpendicular thereto, said tufts forming a series of even numbered, parallel rows aligned parallel in a direction transverse and perpendicular to the longitudinal axis of said handle, the ends of said bristles of said juxtaposed tufts of said rows together forming a wedge-shape having two outward facing, flat bevel surfaces symetrical to each other; whereby said major brush portion can be used to clean the major tooth surfaces, the edge between said cylindrical surface and said flat beveled surface can be used to massage the gingivae without a traumatic effect on the gingival attachments, all as the brush is used with the natural back-and-forth brushing action, and, as a supplement to said major brush portion, said interdental brush portion can be used as most effective cleanser of interdental and interproximal spaces and as an interdental stimulator without a traumatic effect on the crest of the interdental papillae.

2. The brush of claim 1 wherein said cylindrical work surface is centrally located with respect to said rectangular configuration and wherein there are two adjacent, flat beveled surfaces, one along each side edge of said cylindrical surface, said major brush portion being symetrical about the plane through its center along said longitudinal axis.

3. The brush of claim 2 wherein said cylindrical surface forms a shallow cavity having a depth of the order of one-half to three-quarters millimeters.

4. The brush of claim 1 wherein said interdental brush portion has two rows of juxtaposed tufts.

5. An interdental toothbrush comprising:

an elongated handle having an end portion with a top side; and a relatively small interdental brush portion mounted on said end portion on said top side consisting of a single group of parallel, juxtaposed tufts, defining at least generally a rectangular configuration, of parallel bristles emanating out from said handle in a direction perpendicular thereto, said tufts forming a series of even numbered, parallel rows aligned parallel in a direction transverse and perpendicular to the longitudinal axis of said handle, the ends of said bristles of said juxtaposed tufts of said rows together forming a single wedge-shape having two outward facing, flat bevel surfaces symetrical to each other, the top side of said end portion of said single group of tufts, forming said single wedge-shape, being otherwise clear of any other tufts of bristles or other substantial projections, the total size of the wedge-shape formed by said tufts being of an interdental size for fitting in between the sides of two juxtapositioned teeth with said bevel surfaces contacting the sides of the teeth; whereby said interdental brush portion can be used as a most effective interdental and periodontal cleanser and as an interdental stimulator without a traumatic effect on the crest of the interdental papillae.

6. The toothbrush of claim 8 wherein there is further provided:

a major brush portion, mounted on the end portion opposite that end portion on which said interdental brush is mounted, consisting of a group of juxtapaosed tufts, defining at least generally a rectangular configuration, of bristles emanating out from said handle in a direction at least generally perpendicular thereto, the ends of said bristles of said juxtaposed tufts together forming a contoured, cylindrical working surface the axis of which is parallel to the longitudinal axis of said handle, said cylindrical surface terminating at at least one side edge thereof in a flat beveled surface which extends the full length of said group of tufts.

7. The brush of claim 6 wherein said cylindrical work surface is centrally located with respect to said rectangular configuration and wherein there are two adjacent, flat beveled surfaces, one along each side edge of said cylindrical surface, said major brush portion being symetrical about the plane through its center along said longitudinal axis.

8. The brush of claim 7 wherein said cylindrical surface forms a shallow cavity having a depth of the order of one-half to three-quarters millimeters.

9. The brush of claim 5 wherein said interdental brush portion has exactly two rows of juxtaposed tufts and none others.

10. The toothbrush of claim 6 wherein said tufts are all parallel, and said bristles are parallel and emanate out from said handle in a perpendicular direction.

* * * * *